United States Patent [19]

Cupps

[11] Patent Number: 4,993,049

[45] Date of Patent: Feb. 12, 1991

[54] ELECTRONIC MANAGEMENT SYSTEM EMPLOYING RADAR TYPE INFRARED EMITTER AND SENSOR COMBINED WITH COUNTER

[76] Inventor: Halbert D. Cupps, 1025 Steeplechase Ct., Apt. 2B, Fort Wayne, Ind. 46804

[21] Appl. No.: 250,305

[22] Filed: Sep. 28, 1988

[51] Int. Cl.[5] ..... G07C 9/00; G08B 13/18

[52] U.S. Cl. ..... 377/6; 340/567; 250/338.1; 250/342

[58] Field of Search ..... 377/6; 340/567; 250/338.1, 342

[56] References Cited

U.S. PATENT DOCUMENTS

| | | | |
|---|---|---|---|
| 4,000,400 | 12/1976 | Elder | 377/6 |
| 4,009,389 | 2/1977 | Lindholm | 377/6 |
| 4,122,331 | 10/1978 | Tsubota et al. | 377/6 |
| 4,159,473 | 6/1979 | Senk | 340/565 |
| 4,195,234 | 3/1980 | Berman | 307/117 |
| 4,278,878 | 7/1981 | Kato | 377/6 |
| 4,344,071 | 8/1982 | Allen | 340/566 |
| 4,346,427 | 8/1982 | Blissett et al. | 250/342 |
| 4,356,387 | 10/1982 | Tsubota et al. | 377/6 |
| 4,510,488 | 4/1985 | St. Jean | 340/567 |
| 4,612,442 | 9/1986 | Toshimichi | 250/353 |
| 4,618,770 | 10/1986 | Maile | 250/338 |
| 4,641,134 | 2/1987 | Stenmark | 340/567 |
| 4,644,147 | 2/1987 | Zublin | 250/221 |
| 4,647,788 | 3/1987 | Maile | 307/117 |
| 4,799,243 | 1/1989 | Zepke | 377/6 |

*Primary Examiner*—John S. Heyman

*Attorney, Agent, or Firm*—Arlyce R. Stearns

[57] ABSTRACT

An infrared sensitive system which maintains an inventory of the number of occupants within a monitored room for controlling certain electronic equipment in response to the presence of occupants within the monitored room. The monitoring system activates the electronic equipment when it senses a person entering the unoccupied room, and it deactivates the electronic equipment when the last person exits the room. Switch members provide for manually resetting and overriding the control portion of the system.

36 Claims, 3 Drawing Sheets

ELECTRONIC MANAGEMENT SYSTEM EMPLOYING RADAR TYPE INFRARED EMITTER AND SENSOR COMBINED WITH COUNTER

BACKGROUND OF THE INVENTION

The present invention pertains generally to infrared sensitive systems, and more particularly to an infrared system which maintains an inventory of persons within a certain zone to control electronic equipment.

It is generally known to provide a detector unit which includes an infrared light source and a lens for focusing infrared radiation onto an infrared detecting element as is described in U.S. Pat. No. 4,275,303, and in U.S. Pat. No. 4,510,488 which describes a passive infrared intrusion detector configured to resemble an electrical wall outlet.

Infrared detection systems such as described in U.S. Pat. No. 4,612,442 to Toshimichi includes an alarm output circuit driven in response to the output generated from a combined counter and comparator. The counter counts pulses to generate an alarm when the number of pulses counted coincides with a preset value. The first input pulse triggers a timer circuit to generate a positive output during a predetermined time interval and controls the count time of the counter.

Certain limitations are implicit in the passive infrared system of Toshimichi. First, the system functions only to actuate an alarm signal. Second, when the pulse generator transmits a low signal, it causes the counter to reset to a base value. Third, there is no provision to deactivate the alarm signal in a certain zone when an intruder leaves the zone.

Consequently, a need exists for improvements in infrared detection systems used to control electronic equipment in response both to the entry into and exit from a certain zone, whereby an electronic device such as a light member, an audio system, a video system and the like, activates when a person enters a certain zone, and deactivates when the last person exits from the certain zone.

SUMMARY OF THE INVENTION

The present invention provides an electronic management system designed to satisfy the aforementioned needs. The invention embodies a unique counting circuit that is simple and maintains an inventory of persons within a certain zone for controlling certain electronic equipment. Furthermore, the inventory value can be manually both reset and overridden. The electronic management system of the present invention is more efficient and less subject to failure than prior electronic control systems.

Accordingly, the present invention relates to an infrared sensitive system for controlling an electronic device in response to the presence of a person within a certain zone. According to the invention, the management system consists of a pair of infrared sensor assemblies positioned within a common housing mounted within an entrance structure to monitor apposing ranges of view. Each assembly is interfaced to support hardware including filter devices, an amplifier, a comparator, a delay trigger and a timer device to convert the output from the sensor to a clock-like pulse. Each assembly is further connected to one of two up/down counters which drive a TRIAC switch circuitry having both a switching transistor and an optoisolator to energize or de-energize the TRIAC switch circuit to control the electronic equipment.

It is in general an object of the invention to provide a new and improved infrared system to control electronic equipment.

Another object of the invention is to provide an infrared system to monitor when a person enters a certain zone to activate electronic equipment while the zone is occupied.

Yet another object of the invention is to count the number of persons who enter the room and who leave the zone.

A still further object of the invention is to maintain an inventory of the number of persons within the zone.

It is yet another object of the invention to deactivate the electronic equipment when the last person leaves the zone.

For better understanding of the present invention, together with other and further objects, reference is made to the following description, taken in conjunction with the accompanying drawings, and its scope will be pointed out in the appended claims.

DETAILED DESCRIPTION OF A PREFERRED EMBODIMENT

Figure 1:
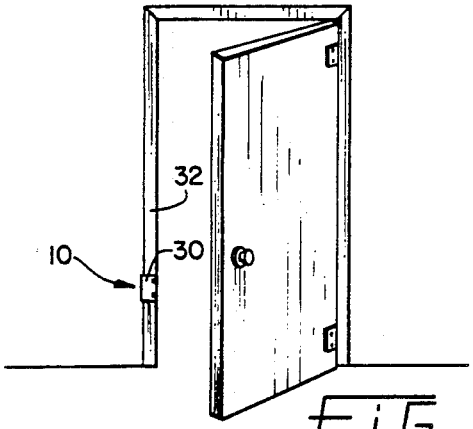
FIG. 1 is a perspective view of the invention mounted in an entrance structure.
Figure 5:
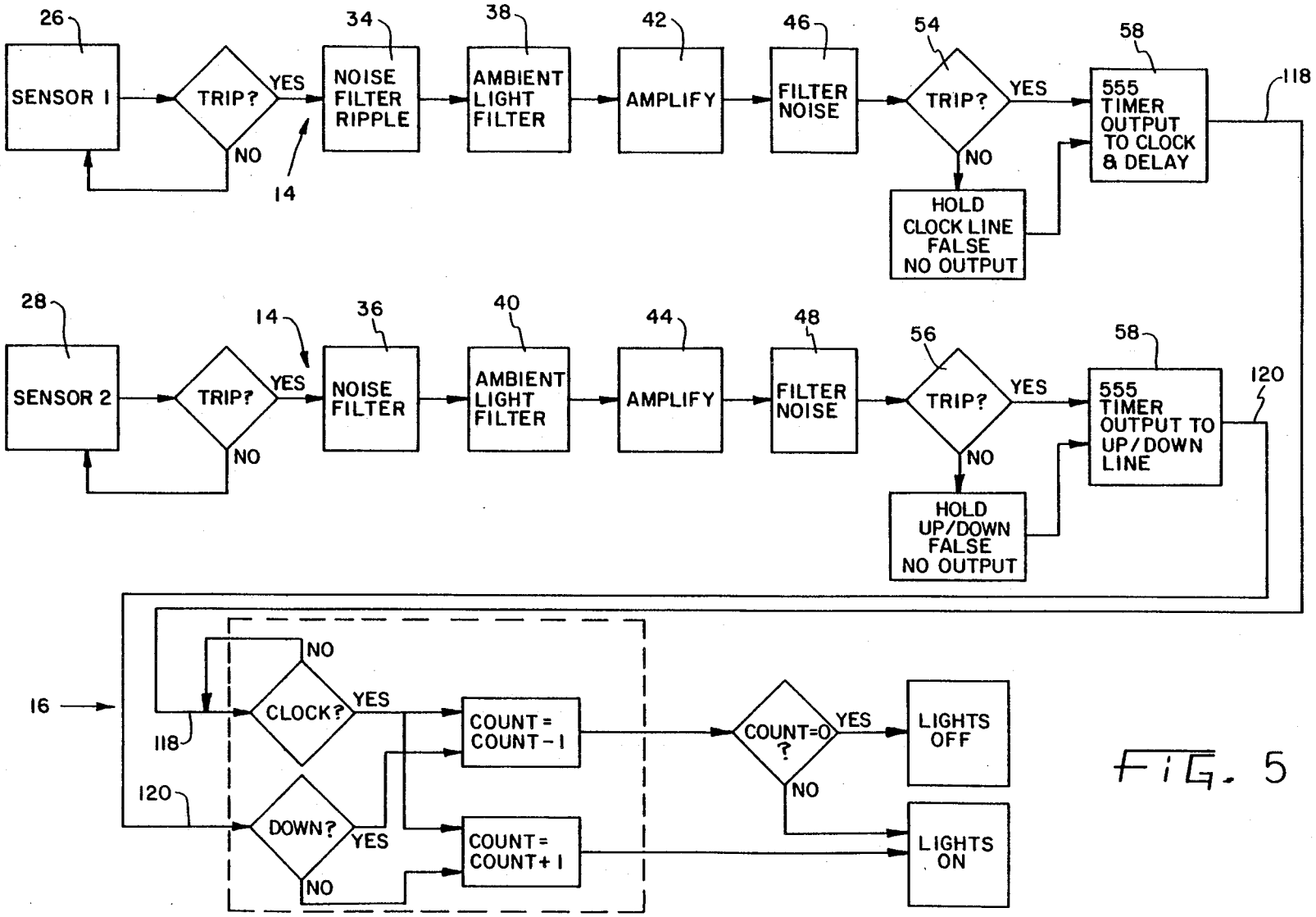
FIG. 5 is a block diagram of the invention shown in FIG. 3.

Referring now to the drawings, and more particularly to FIG. 1, there is shown an infrared detection device, such as an electronic management system generally designated 10, which incorporates the inventory device of the present invention. The electronic management system 10 includes a sensor unit 12 (FIG. 3), support circuitry 14, and a control system 16 (FIG. 5 and 6).

The sensor unit 12 consists of sensor assemblies 18 and 20 (FIG. 6) which include infrared light emitting diodes—LEDs 22 and 24 connected to resisters 19 and 23, respectively, resisters 19 and 23 connect to grounds 21 and 25, respectively, and transistors 26 and 28, preferably infrared sensitive NPN transistors, within a common enclosure 30 mounted in an entranceway member 32 such as a door frame. When an object passes within the view of the sensor unit 12, infrared light will be reflected back to activate one of transistors 26 and 28.

The support circuitry 14 (FIGS. 5 and 6) includes noise filters 34 and 36, ambient light filters 38 and 40, amplifiers 42 and 44, D.C. filters 46 and 48, ripple filters 50 and 52 (FIG. 6), comparators 54 and 56 and a timer 58, preferably a 556 timer.

Figure 6:
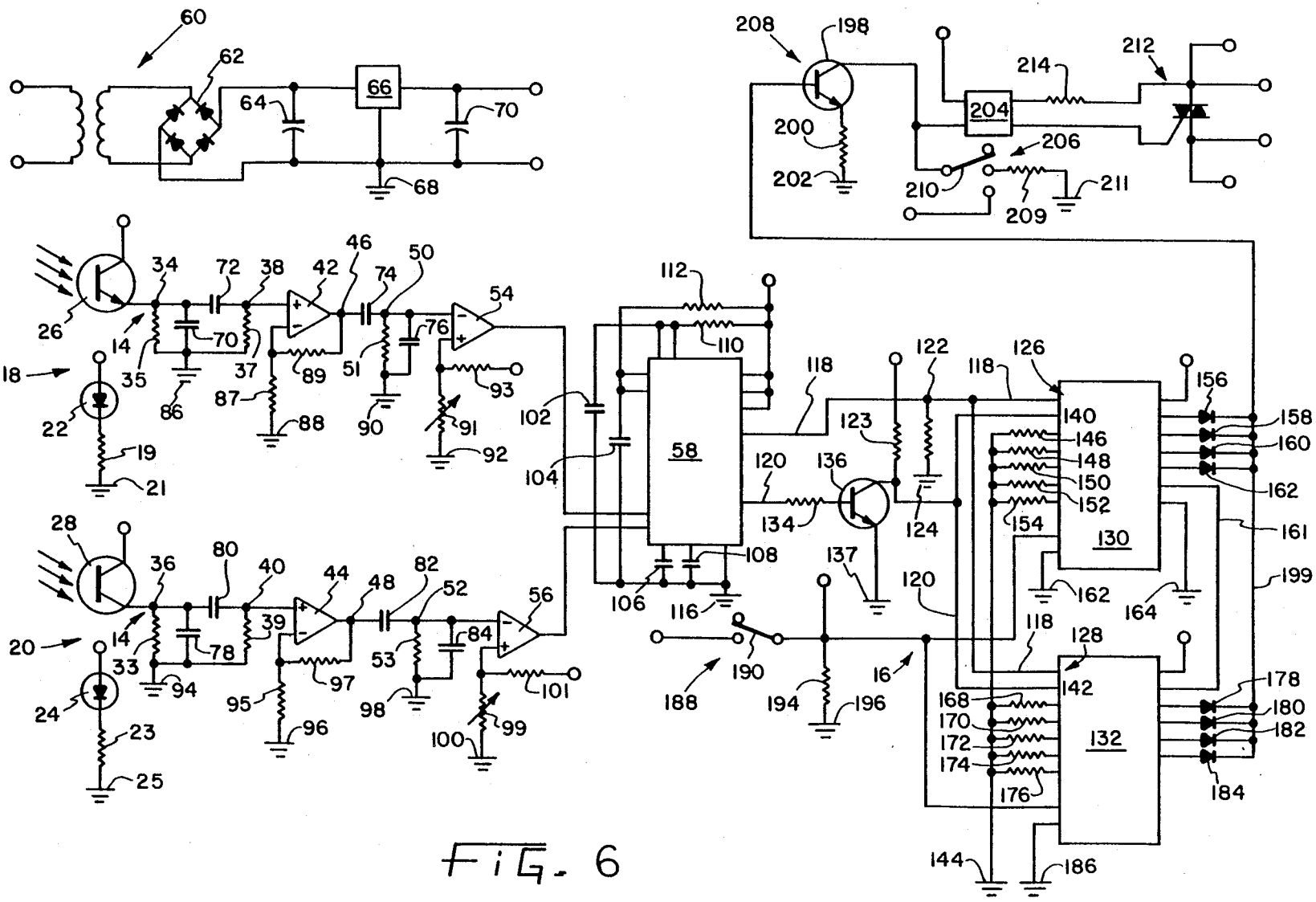
FIG. 6 is a detailed schematic of the invention.

Referring now specifically to FIG. 6, a transformer 60, preferably with a ten to one ratio, includes a rectifier bridge 62, a capacitor 64, a voltage regulator 66 having a ground 68, and a second capacitor 70.

The support circuitry 14 further includes capacitors 70, 72, 74, 76, 78, 80, 82 and 84 and grounds 86, 88, 90, 92, 94, 96, 98 and 100. The output of transistors 26 and 28 is carried by support circuitry 14 to the timer 58 which is coupled to capacitors 102, 104, 106 and 108, to resistors 33, 87, 89, 95, 97, 91, 93, 99, 101, 110, 112, and 114, and to a ground 116. Timer 58 includes clock-line path 118 and up/down path 120.

The clock-line path 118 is coupled to a resistor 122 having a ground 124, and inputs to clock members 126 and 128 of up/down counting members 140 and 142, respectively. The up/down path 120 includes a resistor 134 which connects the timer 58 to a transistor 136. The transistor 136 outputs both to resistor 123 and to up/-down counter members 140 and 142 of the up/down counting members 140 and 142, respectively. The up/-down counter members 140 and 142 are preferably up/down 4-bit counters commonly available in the market.

The up/down counting members 140 and 142 are connected to a common ground 144. Up/down counting member 140 has preset inputs to resistors 146, 148, 150, 152 and 154, and outputs to diodes 156, 158, 160 and 162, and to grounds 164 and 166. Up/down counting member 142 has preset inputs to resistors 168, 170, 172, 174 and 176, and outputs to diodes 178, 180, 182 and 184, and to ground 186. The up/down counting member 140 is further connected to up/down counting member 142 by connecting line 161. In the event additional counting is desired, additional up/down counting members could be added in like manner.

A reset switch circuit 188 includes a manual switch member 190, and couples to both up/down counting members 140 and 142 and a resistor 194 having a ground 196.

Diodes 156, 158, 160, 162, 178, 180, 182 and 184 connect to a control circuit 208 by path 199. The control circuit 208 includes a transistor 198 which connects to a resistor 200 having a ground 202. The transistor 198 also connects to an optoisolator 204 and to a switch circuit 206. The optoisolator 204 connects to a TRIAC 212. A resistor 214 modifies the current to the optoisolator 204. The switch circuit 206 includes a manual switch member 210, such as a three position switch, which overrides the value of the transistor 198.

Basic Operation

Figure 2A:
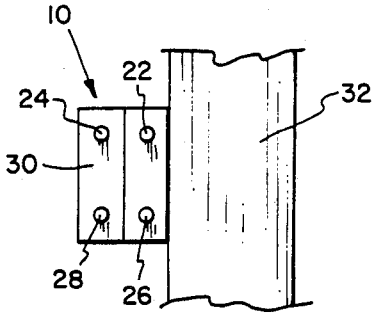
FIG. 2A is a front elevation of the invention as shown in FIG. 1.
Figure 2B:
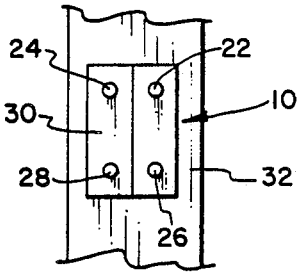
FIG. 2B is an alternate version of mounting the invention as shown in FIG. 2A.

When the electronic management system 10 is in operation, it continually monitors and waits for a person to pass in front of the sensor unit 12. The sensor unit 12 is configured so that the clock members 126 and 128 receive the output of sensor assembly 18, and the up/-down counter members 140 and 142 receive the output of sensor assembly 20. When sensor unit 12 is installed in an entranceway 32 such as a door frame (FIG. 2), sensor assembly 18 will be outermost of the room, and sensor assembly 20 will be innermost to the room.

The up/down line of both counter members 140 and 142 controls whether the counter members 140 and 142 count up or down. When sensor assembly 20 is in a stable or non-triggered state (no objects have been viewed), the up/down line is always tied high (true) which indicates to the counter members 140 and 142 that if the clock members 126 and 128 switches high (true), the counter members 140 and 142 should count positive. Alternatively, the clock line is always low (false) when sensor assembly 18 does not view an object. The stable state will hold the counter members 140 and 142 at their current count (from zero (0) to a positive value other than zero), which enables the control system 16 to maintain an inventory of the occupancy of the room.

A. Entry Into The Room

Figure 3:
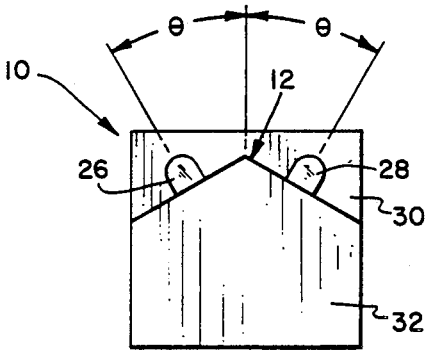
FIG. 3 is a top plan of the invention as shown in FIG. 2.

When the electronic management system 10 is installed to monitor an entranceway 32, the counter members 140 and 142 are preset to a value such as zero (-0-) and the electronic equipment (not shown) such as a light member, an audio system, and the like, are off. This is the "stable" or "idle" mode of operation. The sensor assemblies 18 and 20 are configured whereby one of the sensor assemblies 18 and 20 will always to first to view a person passing through the entranceway 32. This is accomplished by orienting the sensor assemblies 18 and 20 away from each other as shown in FIG. 3.

Figure 4A:
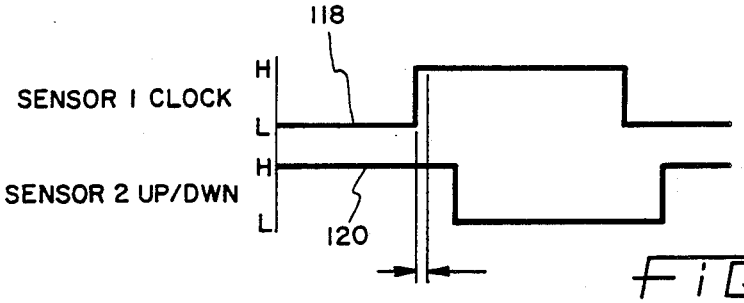
FIG. 4A is a timing diagram of the invention with a positive pulse count.

Referring now to FIG. 4A, as a person enters the room through entranceway 32, the infrared light from LED 22 will be reflected back to the transistor 26 first, while at that same time, sensor assembly 20 will remain idle (non-triggered). Since sensor assembly 18 was triggered by a person entering the room, it will transmit a pulse signal to the clock-line path 118 which leads to the up/down counter members 140 and 142 and activates counter members 140 and 142 to count one time. At this same time, the up/down path 120 remains stable (non-triggered), and set true as previously described. This results in causing the counter members 140 and 142 to count up, i.e., to add one (1+) to the count. An important feature of this invention is that the counter members 140 and 142 will count only during the instant that the clock-line path 118 switches from low to high, i.e., only on the "rising edge" of the pulse. Once the clock-line path 118 returns to low, the switching is complete and the count is also complete. The counter members 140 and 142 *will not* count when the clock-line path 118 returns from high to low (false). During the time the clock-line path 118 switches from high to low, therefore, sensor assemblies 18 and 20 enter a "reset" state in which the clock-line path 118 returns to the stable state to allow it to receive the next signal for the next pulse or count as shown in FIG. 4A.

Once the sensor assembly 18 is tripped high, it is held high by the timer 58 for a short period of time, preferably for at least five-tenths (0.5) to at least one (1) second. This interval allows a person to pass through the entranceway 32 without generating a false trigger by an arm movement or a shadow. The delay also permits the sensor assemblies 18 and 20 to return to the stable state. As the person continues through the entranceway 32 into the room, the sensor assembly 20 will be triggered, but because the sensor assembly 18 has been triggered, the sensor assembly 20 will have no effect because the count is completed as shown in FIG. 4A.

Once the sensor assembly 18 is triggered to activate a positive count of at least one (1+), the up/down counting members 140 and 142 will output a high or true value along path 199 to activate the TRIAC switching circuit 208 which will activate the optoisolator 204. The optoisolator 204 will provide a gate pulse to the TRIAC switch 212, and the electronic equipment such as a light member will turn on. After the person is within the room, the sensor assemblies 18 and 20 will return to the idle mode, and the up/down counting members 140 and 142 will be set to a preset value of at least one (1) greater than the preset value.

This procedure will repeat each time another person enters the room. The up/down counting members 140 and 142 will continue to count up to a maximum value which may be at least 255. After the first person triggers the electronic equipment to turn on, however, the electronic equipment will remain on, i.e., no other switching will occur as additional people enter the room.

B. Exit From The Room

Figure 4B:
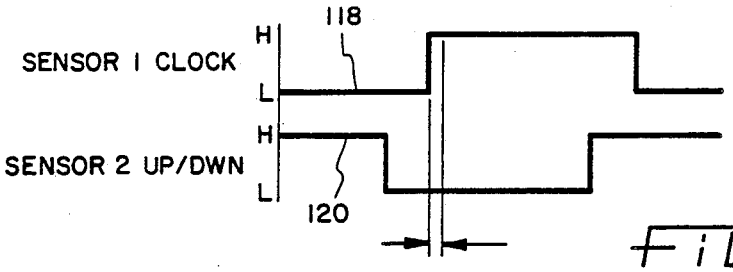
FIG. 4B is a timing diagram of the invention with a negative pulse count.

The principles of operation are similar to those upon entering the room, but in reverse as shown in FIG. 4B. In this case, the sensor assembly 20 is triggered first, and its output switches from high to low. This action will activate the up/down counting members 140 and 142 to count down. The up/down path 120 will stay low for approximately five-tenths (0.5) to at least one (1) second by the same means and for the same reasons as for the clock-line path 118. A count *will not* occur until the clock-line path 118 switches from low to high. Thus as the person moves into view of sensor assembly 18, its output will switch from low to high indicating that the up/down counting members 140 and 142 should take a count. At that time, because the sensor assembly 120 was triggered first, the output is low, and this causes the up/down counting members 140 and 142 to count down, i.e., subtract one (1−) from its current value.

If this is the last person to leave the room, the up/down counting members 140 and 142 will return to its preset value or low. This will cause the switching circuit 208 to turn off and that will turn off the TRIAC switch 212 and the electronic equipment will turn off.

The Circuitry

Referring now specifically to FIG. 6, the transistors 26 and 28 are preferably NPN infrared sensitive transistors. The LED 22 and 24 are light emitting diodes such as infrared light emitting diodes which are mounted as shown in FIG. 3 and deflected at an angle which ranges from at least 25 degrees to at least 45 degrees from the midline. This allows the transistors 26 and 28 to detect objects independently and will be referred to as the "center view" angle.

The distance of view or sensitivity is defined by the operational amplifiers 42 and 44, as well as by the operational amplifer—comparators 54 and 56. The amplifier gain is set by resistors 87, 89, 95 and 97. The trip level on the comparators 54 and 56 is set by resistors 91, 93, 99 and 101.

Ambient light effect and incandescent as well as power supply noise and transients are filtered by resistors 35 and 93 and by capacitors 70, 72, 78 and 80. Capacitor 72 and resistor 37 generate a positive going pulse when the transistor 26 is activated. This pulse is then amplified by operational amplifier 42. This function is identical from the transistor 28 with capacitor 80, resistor 39 and operational amplifier 44.

The amplified pulse from operational amplifier 42 then passes to capacitor 74, resistor 51 and capacitor 76 which further refines the trigger pulse in sensor assembly 18. In like manner, capacitor 82, resistor 53 and capacitor 84 perform the same function in sensor assembly 20. If the pulse is higher than the trip point set by resistors 91 and 93 (sensor assembly 18), or by resistors 99 and 101 (sensor assembly 20), the comparator 54 or 56 will trip from a value of at least +5 Vdc to -0- Vdc, indicating that a trigger or detection has occurred, and the 556 timer is triggered.

The 556 timer 58 includes at least two 555 timers each independent and one for each of transistors 26 and 28. The function for each of the transistors 26 and 28 respective timer when triggered is to output a high pulse (at least +5 Vdc) for a time period defined by the values of capacitor 102 and resistor 110 for transistor 26, and capacitor 104 and resistor 112 for transistor 28. The time delay gives the support circuitry 14 time to settle to a static state before allowing another object to be recognized.

The 555 timer output connected to transistor 26 is connected directly to the clock-line path 118 on the up/down counting members 140 and 142. The output of the transistor 28 is inverted to effect the same application. This inversion incorporates transistor 136 and resistor 134. When the 555 timer connected to sensor assembly 20 sends a high (+5 Vdc) signal, the transistor 136 will switch low for as long as the 555 timer output is high. The low signal is recognized on the collector of transistor 136 and is connected to the up/down path 120 of up/down counting members 140 and 142 such as up/down 4-bit counters.

The clock-line path 118 is normally tied to -0- Volts or ground through the resistor 122 when the transistor 26 is not triggered. The up/down path 120 is tied to at least +5 Vdc through resistor 138 when the transistor 28 is not triggered.

In one embodiment of the invention, counting member 140 acts as the least significant 4-bits, and counting member 142 acts as the most significant 4-bits, i.e., counting member 140 will do all or most of the counting up to at least 15. When counting member 140 reaches its maximum, it will roll over and its "carry out line" 161 will change states to tell the counting member 142 to increment one time. Thus, on the subsequent count (count 1+) counting member 140 will begin counting again and the process will continue. Each time counting member 140 exceeds a value of at least 15, counting member 142 will add one count to itself. The count down process operates in reverse.

Both counting members 140 and 142 are tied together through diodes 156, 158, 160, 162, 170, 186, 182 and 184 which act as OR gates 130 and 132, whereby the output of at least one of the counting members 140 and 142 is high (+5 Vdc) then the output of the respective one of OR gates 130 and 132 will be high and the switching transistor 198 will be turned on.

Once triggered, the switching transistor 198 drives the internal LED (not shown) in the optoisolator 204. This LED activates a small TRIAC (not shown) also internal to the optoisolator 204. When the internal TRIAC is on it creates a gate for the larger TRIAC 212. When the larger TRIAC 212 is gated, it turns on the electronic equipment connected to it.

Reset circuitry 188 includes switch member 190, resistor 194 and ground 196. When first turned on, reset circuitry 188 will reset the counting members 140 and 142 to a preset value such as zero (-0-). This reset switch circuit 188 is included for a manual reset option.

Switch member 206 and resistor 210 are included to override the control system 16. If the user wants the electronic equipment on without the control system 16 turning it off, this can be accomplished through switch member 206. Once switched on, the electronic equipment will remain on regardless of the value of the counting members 140 and 142. Switch member 206 and resistor 210 thus functions as a control override switch and it can also function to turn off the electronic equipment notwithstanding the count value of up/down counting members 140 and 142.

While alternate embodiments of this invention have been described, it will be understood that it is capable of further modifications. This application is, therefore, intended to cover any variations, uses, or adaptations of the invention following the general principles thereof, and including such departures from the present disclosure as come within known or customary practices in the art to which this invention pertains and falls within the limits of the appended claims.

What is claimed is:

1. An electronic management system, comprising:

means for emitting infrared light;

means combined with said emitting means for sensing infrared light reflected from an object within a range of view of a certain zone of detection;

means for comparing pulses triggered by said sensing means to a reference value;

means connected with said comparing means for timing each of said pulses triggered to provide error free delayed clock-like pulses;

means for mounting said emitting means next to said sensing means to provide same side detection with said range of view of said certain zone;

means connected with said timing means for controlling an electronic means such as a light means, an audio device, a video device, and the like, said control means including means for counting in one of a positive value and a negative value in relation to a reference value when triggered by one of said delayed pulses;

means for mounting said controlling means whereby said controlling means is connected to said electronic means; and means for manually operating said counting means.

2. The system according to claim 1, wherein said timing means has a certain reference value.

3. The system according to claim 1, further comprising means controlled by said timing means for relaying said pulses from said sensing means.

4. The system according to claim 3, wherein said pulse relaying means comprises a first line means and a second line means.

5. The system according to claim 1, wherein said control means further includes a clock means whereby said control means is adapted to count at a predetermined time period.

6. The system according to claim 1, wherein said emitting means comprises an infrared light emitting diode means.

7. The system according to claim 1, wherein said sensing means comprises an infrared sensitive transistor means.

8. The system according to claim 1, wherein said emitting means comprises a first infrared emitting diode means and a second infrared emitting diode means.

9. The system according to claim 1, wherein said sensing means comprises a first sensor means and a second sensor means, whereby one of said first sensor means and said second sensor means views one of a first range and a second range of said certain zone, and the other of said first sensor means and said second sensor means views the other one of said first range and said second range of said certain zone.

10. The system according to claim 1, wherein said means for mounting said sensor means comprises a chassis means.

11. The system according to claim 1, wherein said means for mounting said controlling means comprises an enclosure means.

12. The system according to claim 11, wherein said enclosure means is mounted in a structure member such as a wall member, a floor, and the like.

13. The system according to claim 11, wherein said enclosure means is adapted to connect to an electrical circuit and to receive a connection to said electronic means.

14. The system according to claim 1, wherein said manual operating means comprises switching means for one of manually resetting and manually overriding said value of said counting means.

15. The system according to claim 1, wherein said manual operating means comprises means for manually switching said counting means whereby said electronic means is controlled by said manual switch means.

16. The system according to claim 1, wherein said manual operating means comprises a first switch means and a second switch means whereby one of said first switch means and said second switch means is adapted for one of resetting and overriding said value of said counting means, and the other of said first switch means and said second switch means is adapted for the other of resetting and overriding said value of said counting means.

17. The system according to claim 16, wherein one of said first switch means and said second switch means provides for one of at least two switch positions and more than two switch positions, and the other of said first switch means and said second switch means provides for the other of at least two switch positions and more than two switch positions.

18. The system according to claim 9, further comprising means intermediate said timing means and said control means for relaying said pulses, said relaying means comprising a first line means and a second line means whereby at a predetermined period of time, when one of said first line means and said second line means lies in one of an upward mode and a downward mode, said counting means will count in one of said positive value and said negative value, and when said one of said first line means and said second line means lies in the other of said upward mode and said downward mode, said counting means will count in the other of said positive value and said negative value.

19. The system according to claim 18, wherein said timining means comprises a first timer means and a second timer means, one of said first timer means and said second timer means being connected to one of said first line means and said second line means, the other of said first timer means and said second timer means being connected to the other of said first line means and said second line means.

20. The system according to claim 18, wherein one of said first range of view and said second range of view extends from a median point to a predetermined angle to the left in said certain zone, and the other of said first range of view and said second range of view extends from said median point to a predetermined angle to the right in said certain zone.

21. The system according to claim 19, wherein one of said first line means and said second line means relays said pulse output from one of said first sensor means and said second sensor means and the other of said first line means and said second line means relays said pulse output from the other of said first sensor means and said second sensor means.

22. The system according to claim 21, wherein said counting means counts in one of said positive value and said negative value when one of said first sensor means and said second sensor means views an object, and counts in the other of said positive value and said negative value when the other of said first sensor means and said second sensor means views an object.

23. The system according to claim 22, wherein one of said first line means and said second line means has a certain reference point whereby said pulse output triggers a clock means connected to said counting means, and said counting means will count in one of said positive value and said negative value in accordance with said pulse output relayed by said one of said first line means and said second line means.

24. The system according to claim 23 wherein said electronic means is connected to said counting means, whereby when said counting means has one of a reference value and a value other than said reference value, said counting means does one of activate and deactivate said electronic means, and when said counting means has the other of said reference value and said value other than said reference value, said counting means does the other of activate and deactivate said electronic means.

25. The system according to claim 24, wherein said manual operating means comprises a first switch means and a second switch means whereby one of said first switch means and said second switch means can be used for one of resetting and overriding said value of said counting means, and the other of said first switch means and said second switch means can be used for the other of resetting and overriding said value of said counting means.

26. The system according to claim 25, wherein said means for mounting said control means comprises an enclosure adapted for connecting said control means to said electronic means.

27. An electronic management system, comprising:

means for monitoring a certain zone or range of view for ingress and egress of occupants through said zone or range of view whereby said monitor means comprises a unit member having a first monitor set and a second monitor set, each of said first monitor set and said second monitor set including means for emitting infrared light combined with means for sensing infrared light reflected from an object within said certain zone;

means connected to said monitor means for maintaining an inventory of said occupants within said zone, whereby said inventory means comprises means for comparing pulses triggered by said sensing means to a reference value, said comparing means including means for filtering ambient noise, means for filtering ambient light, means for amplifying said pulse, and means for timing said pulse whereby a clock-like signal is established;

means for mounting said monitor means and said inventory means comprising a common housing unit whereby said emitted light originates from and said infrared light reflection is received in said common housing unit mounted in a predetermined location substantially central within said certain zone or range of view; and means for comparing pulses triggered by said sensing means to a reference value, said comparing means including: means for filtering ambient noise, means for filtering ambient light, means for amplifying said pulse, and means for timing said pulse whereby a clock-like signal is established.

28. The system of claim 27 further comprising means connected to said timing means for relaying said pulse to said inventory means, said relaying means comprising a first line means and a second line means, whereby one of said first monitor set and said second monitor set is connected to one of said first line means and said second line means, and the other of said first monitor set and said second monitor set is connected to the other of said first line means and said second line means.

29. The system of claim 28, wherein said one of said first monitor set and said second monitor set is disposed to view one of a first range and a second range of said certain zone and the other one of said first monitor set and said second monitor set is disposed to view the other of said first range and said second range of said certain zone.

30. The system of claim 29, wherein said inventory means comprises a clock means, means for counting said pulses in one of a negative value and a positive value, and means for comparing a combination of said positive values with said negative values with a reference value thereby providing an inventory of said occupants within said certain zone.

31. The system of claim 30, wherein one of said first line means and said second line means is connected to one of said clock means and said counting means, and the other of said first line means and said second line means is connected to the other of said clock means and said counting means.

32. The system of claim 31, wherein said counting means counts in one of said positive value and said negative value when one of said first monitor set and said second monitor set views an occupant within one of said first range of view and said second range of view, and counts in the other of said positive value and said negative value when the other of said first monitor set and said second monitor set views an object within the other of said first range of view and said second range of view.

33. The system of claim 32, wherein said clock means is activated when said pulse output reaches a certain reference point on said one of said first line means and said second line means whereby said counting means will count in one of said positive value and said negative value in reference to said pulse output on the other of said first line means and said second line means.

34. The system of claim 33, wherein said inventory means is connected to said electronic means whereby said electronic means is one of activated and deactivated when said inventory value is one of said reference value and other than said reference value and said electronic means is the other of activated and deactivated when said inventory value is the other of said reference value and other than said reference value.

35. The system of claim 34, wherein said manual operating means comprises means for switching said inventory means to reset, override, and the like, said inventory value manually to one of activate and deactivate said electronic means.

36. An improved infrared monitoring system wherein a device is activated by infrared light reflected from an object within a certain range of view to activate a control member connected to an electronic device whereby said electronic device is activated, wherein the improvement comprises:

an infrared sensitive monitoring unit means for relaying a pulse in reaction to infrared light reflected from an object, said unit means comprising a first monitor set and a second monitor set;

means for mounting said unit means in a certain zone whereby one of said first monitor set and said second monitor set has one of a first range of view and a second range of view of said certain zone and the other of said first monitor set and said second monitor set has the other of said first range of view and said second range of view of said certain zone, and one edge of one of said first range of view and said second range of view abuts one edge of the other of said first range of view and said second range of view;

means connected to said unit means for translating said relayed pulses into one of a positive value and a negative value, said translating means comprising:

clock means for establishing a reference period of time to respond to each of said relayed pulses, means for counting comprising a first counting member and a second counting member, whereby one of said first counting member and said second counting member counts in one of a positive mode and a negative mode and the other of said first counting member and said second counting member counts in the other of said positive mode and said negative mode, means for combining said positive values and said negative values, said combining means having a reference value, and means for connecting said translating means to said electronic means whereby when said combined value has one of said reference value and a value other than said reference value, said electronic means is one of activated and deactivated, and when said combined value has the other of said reference value and other than said reference value, said electronic means is the other of activated and deactivated; and means for connecting one of said first monitor set and said second monitor set to one of said clock means and one of said first counting member and said second counting member, and for connecting the other of said first monitor set and said second monitor set to the other of said clock means and said one of said first counting member and said second counting member.

* * * * *

UNITED STATES PATENT AND TRADEMARK OFFICE

CERTIFICATE OF CORRECTION

PATENT NO. : 4,993,049

DATED : February 12, 1991

INVENTOR(S) : Halbert D. Cupps

It is certified that error appears in the above-identified patent and that said Letters Patent is hereby corrected as shown below:

In Column 4, line 16, change "to" to --be--.

In Claim 1, Column 7, line 26, change "with" to --within--.

In Claim 19, Column 8, line 52, change "timining" to --timing--.

Signed and Sealed this

Fourteenth Day of July, 1992

*Attest:*

DOUGLAS B. COMER

*Attesting Officer*

*Acting Commissioner of Patents and Trademarks*